US007429829B2

(12) United States Patent
Chung et al.

(10) Patent No.: US 7,429,829 B2
(45) Date of Patent: Sep. 30, 2008

(54) DISCHARGE LAMP LIGHTING CIRCUIT WITH AN OPEN PROTECTION CIRCUIT

(75) Inventors: Shin-Hong Chung, Guangdong (CN); Kuan-Hong Hsieh, Guangdong (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 165 days.

(21) Appl. No.: 11/309,133

(22) Filed: Jun. 27, 2006

(65) Prior Publication Data

US 2007/0090773 A1 Apr. 26, 2007

(30) Foreign Application Priority Data

Oct. 20, 2005 (CN) ..... 2005 1 0100543

(51) Int. Cl.
*H05B 37/02* (2006.01)

(52) U.S. Cl. ..... 315/224; 315/324; 315/360; 315/291; 315/128; 315/312

(58) Field of Classification Search ..... 315/312, 315/324, 127–129, 360, 224, 247, 219, 225, 315/244, 119, 362, 209 R, 291, DIG. 7
See application file for complete search history.

(56) References Cited

U.S. PATENT DOCUMENTS

| | | | | |
|---|---|---|---|---|
| 4,998,046 | A * | 3/1991 | Lester | 315/209 R |
| 5,068,570 | A * | 11/1991 | Oda et al. | 315/128 |
| 6,555,972 | B1 * | 4/2003 | Lestician | 315/224 |
| 6,710,555 | B1 | 3/2004 | Suzuki et al. | 315/291 |
| 7,208,884 | B2 * | 4/2007 | Bao et al. | 315/244 |

* cited by examiner

*Primary Examiner*—Haissa Philogene
(74) *Attorney, Agent, or Firm*—Winston Hsu

(57) ABSTRACT

A discharge lamp lighting circuit includes a plurality of discharge lamps, a driving circuit, a control circuit, an open protection circuit, which are connected in series. The open protection circuit includes an open control circuit, a delay circuit, and a plurality of open detecting circuits connected in series. Each of the open detecting circuits is connected to a corresponding one of the discharge lamps. One terminal of the open control circuit is connected to the control circuit, and the other terminal of the open control circuit is connected to one terminal of the delay circuit and a predetermined one of the open detecting circuits. The other terminal of the delay circuit is connected to another predetermined one of the open detecting circuits and ground.

12 Claims, 3 Drawing Sheets

DISCHARGE LAMP LIGHTING CIRCUIT WITH AN OPEN PROTECTION CIRCUIT

FIELD OF THE INVENTION

The present invention relates to a discharge lamp lighting circuit, and more particularly to a discharge lamp lighting circuit with an open protection circuit.

DESCRIPTION OF RELATED ART

A discharge lamp, especially a rare gas discharge lamp, is used in lighting devices, various scanners, and Liquid Crystal Displays (LCDs). A discharge lamp has a rare gas such as xenon filled in a glass tube. The glass tube is coated with a fluorescent material on an inner wall of the glass tube, and the rare gas functions as a discharge gas. The discharge lamp is often lighted up by applying a high voltage thereto. The high voltage is obtained by switching a direct current (DC) power source. A primary voltage induced in a transformer is oscillated by a resonant circuit composed of an inductance of the transformer and a stray capacitance at a same time of switching. The primary voltage is applied to the semiconductor for driving and a secondary voltage of the transformer rise.

When a rare gas discharge lamp is not connected or is unlit, the primary voltage of the transformer rises further thereby possibly destroying the semiconductor for driving. At the same time, the secondary voltage of the transformer also rises further generating a high voltage equivalent to a starting voltage continuously; this may result in a dielectric breakdown of the transformer.

In order to solve the above problems, a discharge lamp lighting circuit with an open protection circuit has been devised. Referring to FIG. 3, an exemplary of such discharge lamp lighting circuit includes: a driving means to send a signal to fire a discharge lamp; a control means to control the driving means; a short protection means to protect the driving means by sending a signal to the control means when the discharge lamp is shorted; and an open protection means to protect the driving means by sending a signal to the control means when the discharge lamp is not connected or is unlit.

The open protection means is adapted to send a signal to the control means for limiting a current flowing through the driving means to be at or below a predetermined value when the current is equal to or lower than a predetermined first value, and a signal for sequentially increasing a current flowing through the driving means up to a predetermined current when the current is higher than the predetermined first value and also is equal to or lower than a predetermined second value. The open protection means is also used to stop a driving signal sent from the control means when a current flowing through the discharge lamp has a value equal to or lower than the first value after a predetermined time. Therefore, the discharge lamp lighting circuit can be protected when the discharge lamp is in an open state. However, the invention only discloses a technique involving a discharge lamp lighting circuit with one discharge lamp.

Therefore, a heretofore unaddressed need exists in the industry to overcome the aforementioned deficiencies and inadequacies.

SUMMARY OF INVENTION

A discharge lamp lighting circuit with an open protection circuit is provided for detecting a current of a plurality of discharge lamps, and for stopping a current flowing to a buck converter when any of the discharge lamps is not connected or is unlit.

In one preferred embodiment, the discharge lamp lighting circuit includes a plurality of discharge lamps, a driving circuit, a control circuit, an open protection circuit, which are connected in series. The control circuit controls the driving circuit to power the discharge lamps. The open protection circuit includes an open detecting unit, an open control circuit, and a delay circuit. The open detecting unit includes a plurality of open detecting circuits connected in series. Each open detecting circuit is connected to a corresponding one of the discharge lamps. A first predetermined one of the open detecting circuits is connected to the open control circuit. A second predetermined one of the open detecting circuits is connected to one terminal of the delay circuit and ground. One terminal of the open control circuit is connected to the control circuit, and the other terminal of the open control circuit is connected to the other terminal of the delay circuit and the first predetermined one of the open detecting circuits. Each of the open detecting circuits detects whether the corresponding discharge lamp is unlit. If the corresponding discharge lamp is not lit, the open control circuit sends a voltage control signal to the control circuit, which in turn ceases operating.

An open protection circuit is connected in series between a plurality of power consumers and a control circuit. The control circuit is configured for controlling a driving circuit to powering the power consumers. The open protection circuit includes an open detecting unit, an open control circuit, and a delay circuit. The open detecting unit includes a plurality of open detecting circuits connected in series. Each open detecting circuit is connected to a corresponding one of the discharge lamps. A first predetermined one of the open detecting circuits is connected to the open control circuit. A second predetermined one of the open detecting circuits is connected to one terminal of the delay circuit and ground. One terminal of the open control circuit is connected to the control circuit, and the other terminal of the open control circuit is connected to the other terminal of the delay circuit and the first predetermined one of the open detecting circuits. Each of the open detecting circuits detects whether the corresponding discharge lamp is unlit. If the corresponding discharge lamp is not lit, the open control circuit sends a voltage control signal to the control circuit, which in turn ceases operating.

Other systems, methods, features, and advantages will be or become apparent to one with skill in the art upon examination of the following drawings and detailed description. It is intended that all such additional systems, methods, features, and advantages be included within this description, be within the scope of the present invention, and be protected by the accompanying claims.

DETAILED DESCRIPTION

Figure 1:
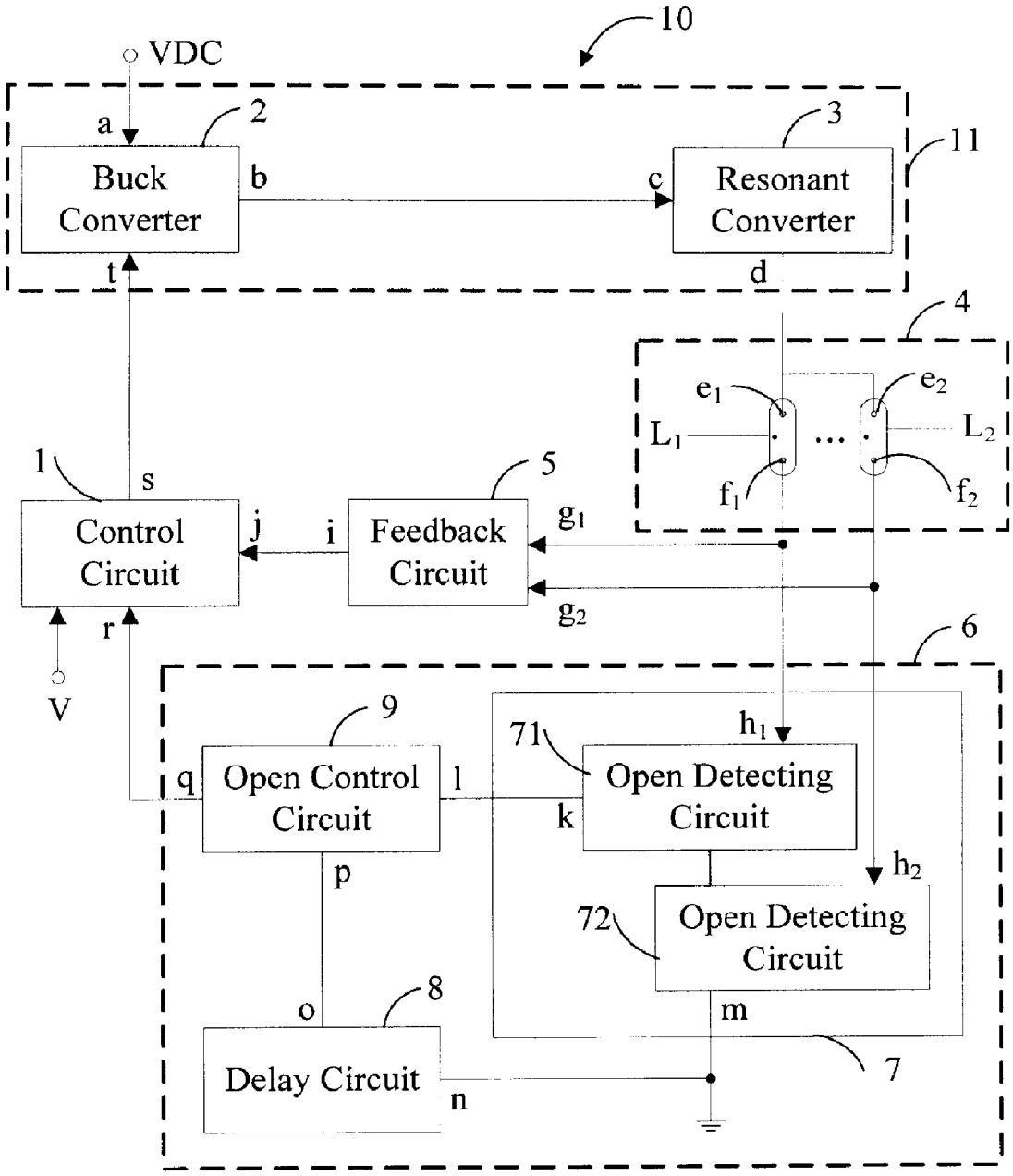
FIG. 1 is a block diagram of a discharge lamp lighting circuit with an open protection circuit according to a preferred embodiment of the present invention.

FIG. 1 is a block diagram of a discharge lamp lighting circuit 10 with an open protection circuit in accordance with a preferred embodiment of the present invention. In this embodiment, the discharge lamp lighting circuit 10 includes a control circuit 1, a driving circuit 11, a plurality of discharge lamps 4, a feedback circuit 5, and an open protection circuit 6. The driving circuit 11 includes a buck converter 2 and a resonant converter 3. The open protection circuit 6 includes an open detecting unit 7, a delay circuit 8, and an open control circuit 9. In the illustrated embodiment, for simplicity, two discharge lamps $L_1$ and $L_2$ are depicted; the open detecting unit 7 includes two open detecting circuits 71 and 72 each corresponds to a respective one of the discharge lamps $L_1$ and $L_2$. The discharge lamps 4 may be a kind of rare gas discharge lamps, such as fluorescent lamps, xenon lamps, and/or Cold Cathode Fluorescent Lamps (CCFLs).

A terminal 's' of the control circuit 1 is connected to a terminal 't' of the buck converter 2. A terminal 'a' of the buck converter 2 is connected to a direct current (DC) power supply (not shown) of a voltage VDC. A terminal 'b' of the buck converter 2 is connected to a terminal 'c' of the resonant converter 3.

A terminal 'd' of the resonant converter 3 is connected to terminals (symbolically depicted as $e_1$ and $e_2$) of each discharge lamp 4. Terminals (symbolically depicted as $f_1$ and $f_2$) of each discharge lamp 4 are connected to terminals (symbolically depicted as $g_1$ and $g_2$) of the feedback circuit 5 and to terminals (symbolically depicted as $h_1$ and $h_2$) of the open detecting circuits 71 and 72 correspondingly.

A terminal 'i' of the feedback circuit 5 is connected to a terminal 'j' of the control circuit 1. A terminal 'k' of the open detecting unit 7 is connected to a terminal 'l' of the open control circuit 9. A terminal 'm' of the open detecting unit 7 is connected to a terminal 'n' of the delay circuit 8. A terminal 'o' of the delay circuit 8 is connected to a terminal 'p' of the open control circuit 9. A terminal 'q' of the open control circuit 9 is connected to a terminal 'r' of the control circuit 1.

When power (not shown) is supplied to the control circuit 1, the control circuit 1 generates a normal pulse signal with a default duty cycle, and sends the normal pulse signal to the buck converter 2. The buck converter 2 receives a DC voltage from the DC power supply (not shown) of the voltage VDC, and converts the DC voltage into a lower DC voltage according to the normal pulse signal from the control circuit 1.

The resonant converter 3 converts the lower DC voltage from the buck converter 2 into a higher alternating current (AC) voltage so as to light the discharge lamps 4. Driven by the higher AC voltage, each of the discharge lamps 4 is normally lit, and each discharge lamp 4 correspondingly outputs an AC signal to the feedback circuit 5 and the open protection circuit 6.

Upon receiving the AC signal from the discharge lamps 4, the feedback circuit 5 feedbacks a first voltage control signal to the control circuit 1. The control circuit 1 receives the first voltage control signal and continuously outputs the normal pulse signal, thereby forming a loop circuit.

The open protection circuit 6 acts as an open circuit when all the discharge lamps 4 are normally lit. The open protection circuit 6 instead produces a second voltage control signal and sends the second voltage control signal to the control circuit 1 when any of the discharge lamps 4 is not lit. Upon receiving the second voltage control signal, the control circuit 1 stops sending the normal pulse signal with a default duty cycle continuously. Thereupon the buck converter 2 stops outputting the higher DC voltage to the resonant converter 3, thereby preventing damage to the discharge lamps 4.

Figure 2:
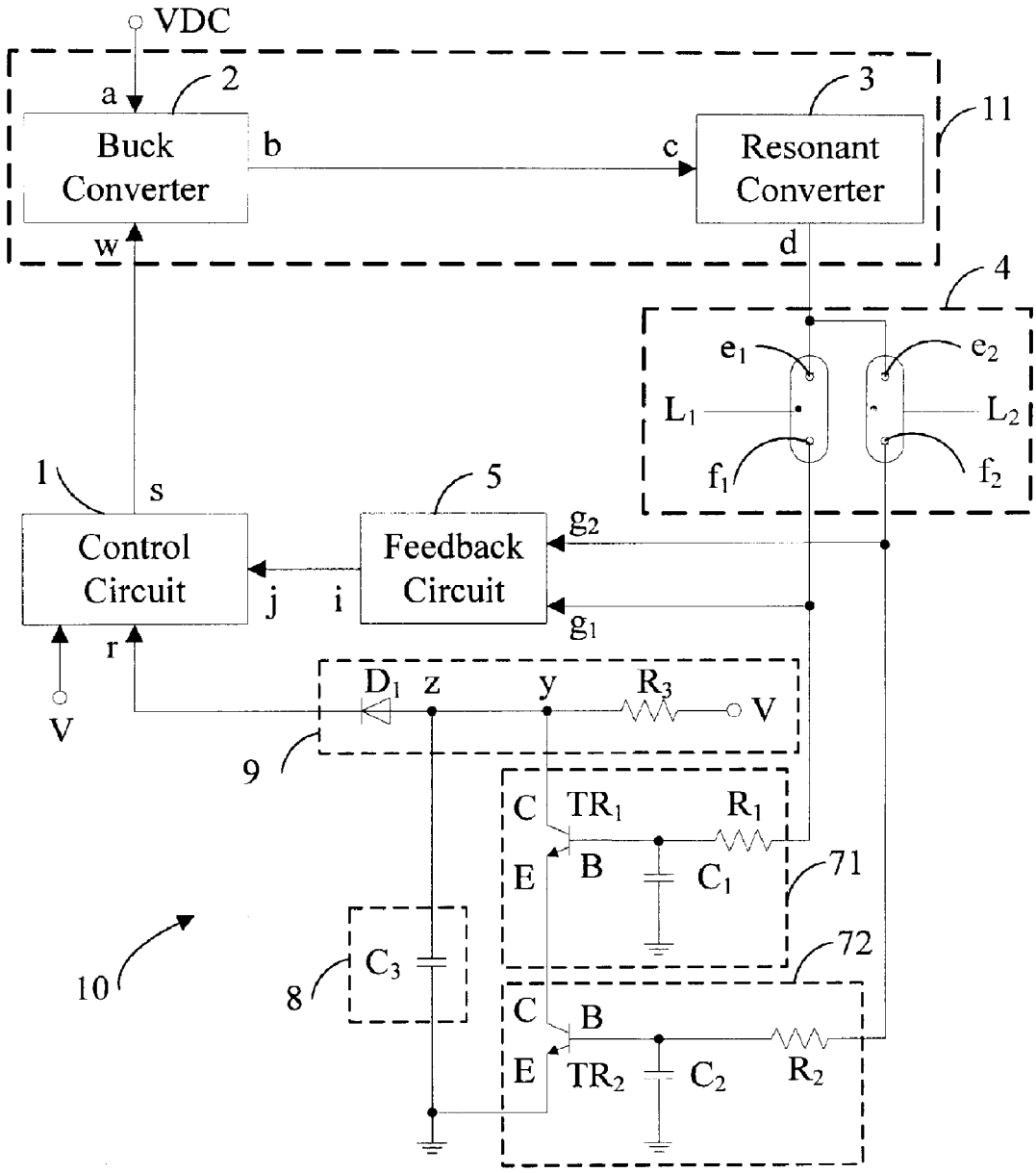
FIG. 2 is a block diagram showing circuitry of a discharge lamp lighting circuit with an open protection circuit according to a preferred embodiment of the present invention.
Figure 3:
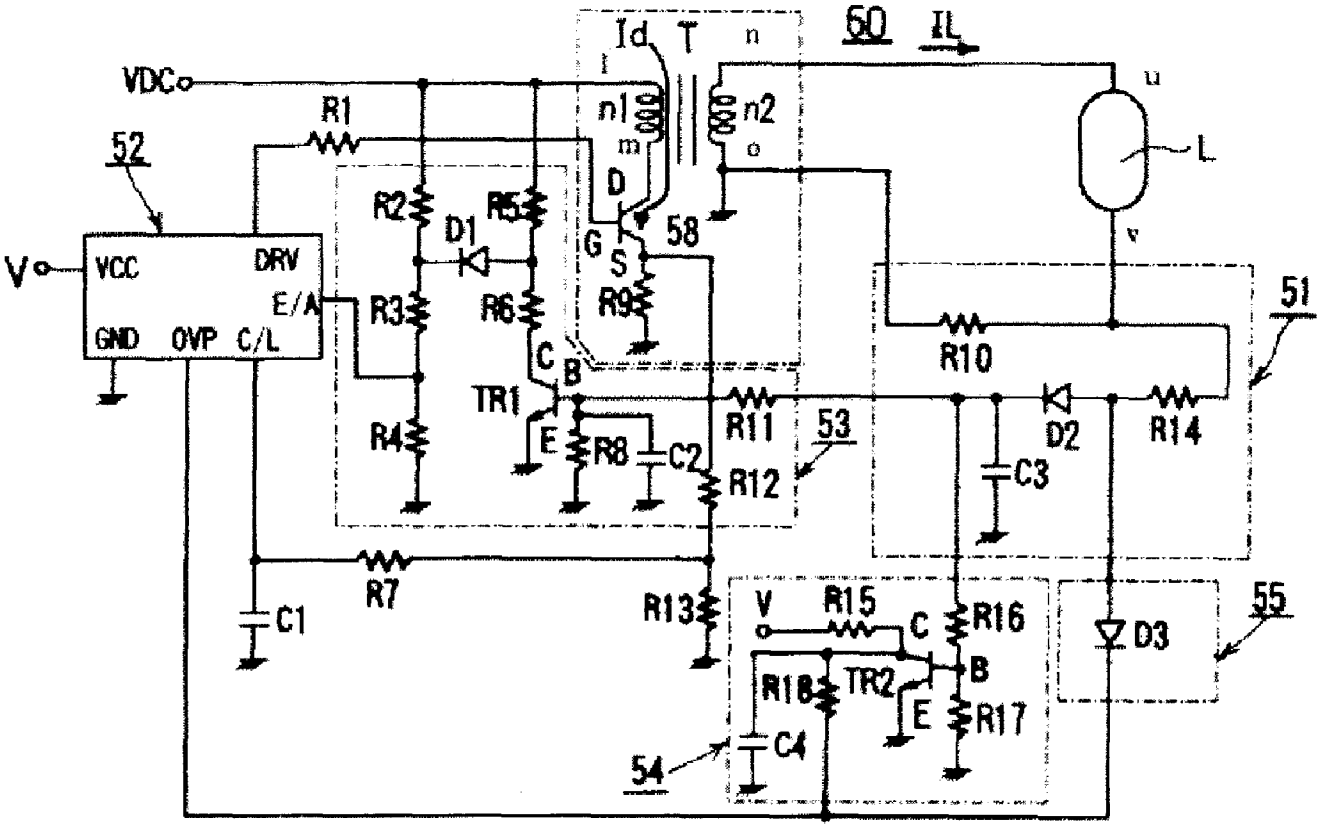
FIG. 3 (RELATED ART)
FIG. 3 is a diagram of a conventional discharge lamp lighting circuit with an open protection circuit.

Referring also to FIG. 2, a discharge lamp lighting circuit 10 with an open protection circuit is detailed. The open protection unit 7 includes two open detecting circuits 71 and 72 corresponding to the arrangement of two discharge lamps 4. Each of the open detecting circuits 71 and 72 is used for detecting AC flowing through the corresponding discharge lamp 4. The open detecting circuit 71 includes a resistor $R_1$, a capacitor $C_1$, and a transistor $TR_1$. The open detecting circuit 72 includes a resistor $R_2$, a capacitor $C_2$, and a transistor $TR_2$. The delay circuit 8 includes a capacitor $C_3$. The open control circuit 9 includes a resistor $R_3$ and a diode $D_1$.

An end of the resistor $R_1$ is connected to the terminal '$f_1$' of the discharge lamp $L_1$. An opposite end of the resistor $R_1$ is connected to a base terminal 'B' of the transistor $TR_1$ and an end of the capacitor $C_1$. An opposite end of the capacitor $C_1$ is grounded. A collector terminal 'C' of the transistor $TR_1$ is connected to a node 'y' between the resistor $R_3$ and the diode $D_1$.

An end of the resistor $R_2$ is connected to the terminal '$f_2$' of the discharge lamp $L_2$. An opposite end of the resistor $R_2$ is connected to a base terminal 'B' of the transistor $TR_2$ and an opposite end of the capacitor $C_2$. A collector terminal C of the transistor $TR_2$ is connected to an emitter terminal 'E' of the transistor $TR_1$. An emitter terminal 'E' of the transistor $TR_2$ is connected to an end of the capacitor $C_3$ that is grounded. An opposite end of the capacitor $C_3$ is connected to a node 'z' between the resistor $R_3$ and the node 'y'.

An anode of the diode $D_1$ is connected to an end of the resistor $R_3$, and a cathode of the diode $D_1$ is connected to the terminal 'r' of the control circuit 1. A reference voltage V is provided to an opposite end of the resistor $R_3$ from an AC power supply (not shown).

At the very start of supplying power to the discharge lamps $L_1$ and $L_2$, the discharge lamps $L_1$ and $L_2$ are not lit, and therefore the AC flow through the discharge lamps $L_1$ and $L_2$ is zero. Consequently, the transistors $TR_1$ and $TR_2$ do not conduct electricity through their corresponding collector terminal C and emitter terminal E, and the capacitor $C_3$ is charged by the AC power supply (not shown) of the reference voltage V until the charge is equal to the reference V after a predetermined period of time has elapsed. The predetermined period of time is dependant by a capacitance value of the capacitor $C_3$. Before the predetermined period of time has elapsed, the potential at the anode of the diode $D_1$ does not reach a first predetermined voltage that allows conductance. Furthermore, if both the discharge lamps $L_1$ and $L_2$ are lit, the discharge lamps $L_1$ and $L_2$ correspondingly output an AC.

The capacitors $C_1$ and $C_2$ integrate the corresponding AC from the discharge lamps $L_1$ and $L_2$ to generate a DC voltage, whereby the transistors $TR_1$ and $TR_2$ conduct itself. The capacitor $C_3$ then discharges to ground. As a result, the potential at the anode of the diode $D_1$ is reduced to zero, and therefore the diode $D_1$ does not conduct current.

After an initial ignition of the discharge lamps 4, the discharge lamps 4 are lit and enter a normal working state. During the normal working state, if one of the discharge lamps $L_1$ or $L_2$ is not lit, for example the discharge lamp $L_1$, then the terminal '$f_1$' of the discharge lamp $L_1$ does not output AC to the transistor $TR_1$, and therefore the transistor $TR_1$ does not conduct current.

Consequently, the capacitor $C_3$ is charged by the AC power supply (not shown) of the reference voltage V until the charge is equal to the reference voltage V after a period of time has elapsed. Therefore the potential at the anode of the diode $D_1$ reaches the first predetermined voltage, and the diode $D_1$ conducts current and outputs the second voltage control signal to the control circuit 1. The control circuit 1 receives the second voltage control signal, and stops its operation. Thereupon the buck converter 2 stops outputting the higher DC voltage to the resonant converter 3, thereby prevents damage to the resonant converter 3 and the discharge lamps 4.

It should be emphasized that the above-described embodiments including preferred embodiments are merely possible examples of implementations, which are set forth for a clear understanding of the principles of the invention. Many variations and modifications may be made to the above-described embodiments. All such modifications and variations are intended to be included herein within the scope of this disclosure and the present invention, and protected by the following claims and their equivalents.

What is claimed is:

1. A discharge lamp lighting circuit comprising a plurality of discharge lamps, a driving circuit, a control circuit for controlling the driving circuit to power the discharge lamps, an open protection circuit, which are connected in series, wherein:

the open protection circuit comprises an open detecting unit, an open control circuit, and a delay circuit;

wherein the open detecting unit comprises a plurality of open detecting circuits connected in series, each open detecting circuit is connected to a corresponding one of the discharge lamps, a first predetermined one of the open detecting circuits is connected to the open control circuit, and a second predetermined one of the open detecting circuits is connected to one terminal of the delay circuit and ground;

one terminal of the open control circuit is connected to the control circuit, and the other terminal of the open control circuit is connected to the other terminal of the delay circuit and the second predetermined open detecting circuit; and each of the open detecting circuits detects whether the corresponding discharge lamp is unlit; if the corresponding discharge lamp is not lit, the open control circuit sends a voltage control signal to the control circuit, which in turn ceases operating.

2. The discharge lamp lighting circuit according to claim 1, wherein the delay circuit comprises a capacitor, one end of the capacitor being connected to the second open detecting circuit and ground, the other end of the capacitor being connected to the open control circuit.

3. The discharge lamp lighting circuit according to claim 1, wherein each open detecting circuit further comprises a resistor, a capacitor, and a transistor.

4. The discharge lamp lighting circuit according to claim 3, wherein one end of the resistor is connected to a corresponding discharge lamp, and the other end of the resistor is connected to a base terminal of the transistor and one end of the capacitor, wherein the other end of the capacitor is grounded.

5. The discharge lamp lighting circuit according to claim 3, wherein a collector terminal of the transistor of one open detecting circuit is connected to the open control circuit or an emitter terminal of the transistor of another open detecting circuit, and an emitter terminal of the transistor of one open detecting circuit is connected to a collector of the transistor of another open detecting circuit or to the delay circuit and ground.

6. The discharge lamp lighting circuit according to claim 1, wherein the open control circuit further comprises a resistor and a diode, one end of the resistor being connected to a reference voltage, the other end of the resistor being connected to an anode of the diode, the delay circuit and the first predetermined one of the open detecting circuits, and a cathode of the diode being connected to the control circuit.

7. An open protection circuit, connected in series between a plurality of discharge lamps and a control circuit, the control circuit being configured for controlling a driving circuit to power the discharge lamps, the open protection circuit comprising:

an open detecting unit, an open control circuit and a delay circuit;

wherein the open detecting unit comprises a plurality of open detecting circuits connected in series, each open detecting circuit is connected to a corresponding one of the discharge lamps, a first predetermined one of the open detecting circuits is connected to the open control circuit, a second predetermined one of the open detecting circuits is connected to one terminal of the delay circuit and ground;

one terminal of the open control circuit is connected to the control circuit, and the other terminal of the open control circuit is connected to the other terminal of the delay circuit and the first predetermined one of the open detecting circuits; and each of the open detecting circuits detects whether the corresponding discharge lamp is unlit; if the corresponding discharge lamp is not lit, the open control circuit sends a voltage control signal to the control circuit, which in turn ceases operating.

8. The open protection circuit according to claim 7, wherein the delay circuit comprises a capacitor, one end of the capacitor being connected to the second predetermined one of the open detecting circuits and ground, the other end of the capacitor being connected to the open control circuit.

9. The open protection circuit according to claim 7, wherein each open detecting circuit further comprises a resistor, a capacitor, and a transistor.

10. The open protection circuit according to claim 9, wherein one end of the resistor is connected to a corresponding discharge lamp, and the other end of the resistor is connected to a base terminal of the transistor and one end of the capacitor, wherein the other end of the capacitor is grounded.

11. The open protection circuit according to claim 9, wherein a collector terminal of the transistor of one open detecting circuit is connected to the open control circuit or an emitter terminal of the transistor of another open detecting circuit, and an emitter terminal of the transistor of one open detecting circuit is connected to a collector of the transistor of another open detecting circuit or to the delay circuit and ground.

12. The open protection circuit according to claim 7, wherein the open control circuit further comprises a resistor and a diode, one end of the resistor being connected to a reference voltage, the other end of the resistor being connected to an anode of the diode, the delay circuit and the first predetermined one of the open detecting circuits; a cathode of the diode being connected to the control circuit.

* * * * *